United States Patent [19]

Ubbink

[11] Patent Number: 5,029,651

[45] Date of Patent: Jul. 9, 1991

[54] POST DRIVER

[76] Inventor: Barney Ubbink, 68 Royal Manor Dr., St. Catharines, Ontario, Canada, L2M 4L6

[21] Appl. No.: 457,148

[22] Filed: Dec. 26, 1989

[51] Int. Cl.[5] ..... E21B 1/02

[52] U.S. Cl. ..... 175/19; 173/90; 173/126; 175/135

[58] Field of Search ..... 175/19, 22, 135; 173/90, 91, 126, 129-131; 405/253, 254, 245, 244, 232; 52/165

[56] References Cited

U.S. PATENT DOCUMENTS

| | | | |
|---|---|---|---|
| 299,086 | 5/1884 | Over | 173/90 |
| 299,344 | 5/1884 | Cavanagh | 173/90 |
| 2,098,146 | 11/1937 | Hunt | 173/126 |
| 2,690,055 | 9/1954 | Lundgren et al. | 173/126 |
| 2,759,486 | 8/1956 | Pesaturo | 173/91 |
| 3,115,199 | 12/1963 | Linabery | 173/126 |
| 3,792,739 | 2/1974 | Deike | 173/126 X |
| 3,823,785 | 7/1974 | Toliver | 173/90 |
| 4,252,472 | 2/1981 | Moraly | 173/126 X |
| 4,790,392 | 12/1988 | Clements | 173/90 X |
| 4,790,533 | 12/1988 | Potthast, Jr. | 173/90 X |

FOREIGN PATENT DOCUMENTS

| | | | |
|---|---|---|---|
| 1200932 | 12/1959 | France | 173/126 |

*Primary Examiner*—Hoang C. Dang

[57] ABSTRACT

A post driver for driving a wedged anchor into the ground wherein said wedged anchor is adapted to receive a post at the top end thereof comprising: an elongated inner shaft having a rectangular cross-section, said inner shaft having one end of which is adapted to be received by said wedged anchor; a plate co-extensive with said rectangular cross-section and fixedly secured at said one end of said elongated inner shaft; a hollow elongated outer shaft having spaced first and second open ends; said first open end of the hollow elongated outer shaft adapted to receive another end of the inner shaft for relative slidable movement therebetween; a mass presented at the second open end; aligned apertures presented by the mass and the outer shaft for receiving one end of a handle to retain the mass and the outer shaft together.

9 Claims, 3 Drawing Sheets

POST DRIVER

FIELD OF THE INVENTION

This invention relates to post drivers for driving a wedged anchor into the ground and particularly relates to a post driver having an inner and outer shaft adapted for slidable relative movement therebetween so as to accurately align the wedged anchor into the ground.

BACKGROUND OF THE INVENTION

Most homes in North America have fences which delineate the property line. Such fences include fence posts which are either driven into the ground or which include drilled holes which are filled with concrete or the like which are adapted to receive such wooden fence posts.

Recently wedged anchors which are made of steel or the like have been used for insertion into the ground so as to serve as anchors for the wooden posts which are secured thereto. In particular, a wedged anchor sold under the trade mark of "MET" post has been appearing on the market place which consist of approximately a three foot long metal anchor having a rectangular socket on one end thereof adapted to receive a wooden post and a wedged spike at the other end which is adapted to be driven into the ground. Once the "MET" post is driven into the ground the wooden post is secured into the rectangular socket.

The "MET" post have normally been inserted into the ground by inserting a short wooden piece of fence and pointing the wedged anchor into the ground and hammering the short wooden piece. Such procedure has normally proved unsatisfactory as it is difficult to maintain the relative vertical position of the "MET" post so as to present a fence having accurately aligned fence posts.

Although the inventor herein is not aware of any apparatus which has heretofore been used to drive such "MET" post into the ground various apparatus and procedures have heretofore been used to drive wooden or metal fence posts into the ground. For example U.S. Pat. No. 4,790,533 teaches apparatus for setting bases at selected locations on a baseball or softball field comprises a base anchor socket designed to be complimentary engagable with stud members associated with the undersides of bases.

Moreover, U.S. Pat. No. 2,098,146 discloses a post driver for driving metallic posts into the ground.

Yet another arrangement is disclosed in U.S. Pat. No. 4,252,472 which discloses a Peg device and method of fixing posts into the ground.

Yet another arrangement is shown in U.S. Pat. No. 299,344 which describes apparatus for driving piles or planks into the ground.

Finally, U.S. Pat. No. 299,086 describes a post driver for driving posts into the ground.

These and other prior art devices are relatively complicated devices which are difficult to utilize in association with wedged anchor or "MET" posts.

It is an object of this invention to provide an improved post driver to be used in association with wedged anchors and to particularly provide a post driver which is easy to use and which is used to accurately vertically align the wedged anchors into the ground.

The broadest aspect of this invention relates to a post driver for driving an wedged anchor into the ground, wherein said wedged anchor is adapted to receive a post at the top end thereof, comprising: an elongated inner shaft having a rectangular cross section said inner shaft having one end of which is adapted to be received by said wedged anchor; a plate coextensive with said rectangular cross section and fixedly secured at said one end of said elongated inner shaft; a hollow elongated outer shaft having spaced first and second open ends said first open end of said hollow elongated outer shaft adapted to receive another end of said inner shaft for relative slidable movement therebetween; mass presented at said second open end extending interiorially into said outer shaft, said mass adapted to strike said other end of said inner shaft when said outer shaft is slidingly moved to an impact position and to be spaced from said other end of said inner shaft when said outer shaft is slidingly moved relative said inner shaft to an open position; said hollow outer shaft including first aperture and said mass including second aperture in the region interiorially of said outer shaft for alignment with said first aperture; a handle having two spaced ends secured to said outer shaft, one of said ends of said handle projecting through said first aperture of said outer shaft and into said second aperture of said mass interiorially of said outer shaft so as to retain said mass and said outer shaft together, said handle for moving said outer shaft relative said inner shaft between said open and impact positions.

It is another aspect of this invention to provide a post driver for driving a wedged anchor into the ground, said wedged anchor including a square opening at the top thereof for receiving a wooden post comprising: a hollow inner shaft having a square cross section along the axial length thereof; a plate coextensive with said square cross section of said inner shaft and fixedly secured at said one end of said hollow inner shaft; an enlarged square engaging portion presented at one end of said inner shaft for reception by said opening at the top of said wedged anchor so as to substantially eliminate rotational movement of said wedged anchor about said axis of said first shaft; an anvil presented at another end of said inner shaft; a hollow outer shaft having a square cross section along the axial length thereof, said outer shaft including an open end adapted to slidingly receive said inner shaft interiorially of said outer shaft for relative slidable movement therebetween so as to substantially eliminate rotational movement of said outer shaft with said inner shaft along the axial length of inner and outer shafts; mass presented at another end of said outer shaft and extending interiorially into said outer shaft at said another end, said mass adapted to strike said anvil of said inner shaft when said outer shaft is slidingly moved to an impact position, and to be spaced from said anvil when said outer shaft is slidingly moved relative said inner shaft to an open position; said hollow outer shaft including first aperture and said mass including second aperture in the region interiorially of said outer shaft for alignment with said first aperture; a handle having two spaced ends secured to said outer shaft, one of said ends of said handle projecting through said first aperture of said outer shaft and into said second aperture of said mass interiorially of said outer shaft so as to retain said mass and said outer shaft together, said handle for moving said outer shaft relative said inner shaft between said open and impact positions; gusset connecting said outer shaft and said handle.

Finally it is an aspect of this invention to provide a method of installing a wooden post to a wedged anchor having an opening at the top thereof adapted to receive said post, including the steps of: positioning said wedged anchor into the ground so as to present the opening of said wedged anchor at the top thereof; vertically aligning an inner shaft relative said wedged anchor whereby one end of said inner shaft is inserted into said opening of said wedged anchor; positioning a hollow outer shaft having an opening at one end and a closed end over said inner shaft for relative slidable movement therebetween; grasping handles presented along said outer shaft so as to [slightingly] slidingly move said outer shaft relative said inner shaft between an open position where said closed end of said outer shaft is spaced from another end of said inner shaft, and an impact position where said closed end of said outer shaft strike said other end of inner shaft so as to drive said inner shaft and said wedged anchor into the ground; vertically aligning said wedged anchor when driving said wedged anchor into the ground by wrenching the handles while slidingly moving said outer shaft to said impact positions; removing said inner and outer shafts from said wedged anchor; inserting a wooden post into said open end of said wedged anchor; vertically aligning said wooden post; securing said wooden post to said anchor; constructing a fence from said secured wooden posts.

DRAWINGS

DETAILED DESCRIPTION OF THE INVENTION

Like parts have been given like numbers throughout the figures.

Figure 1:
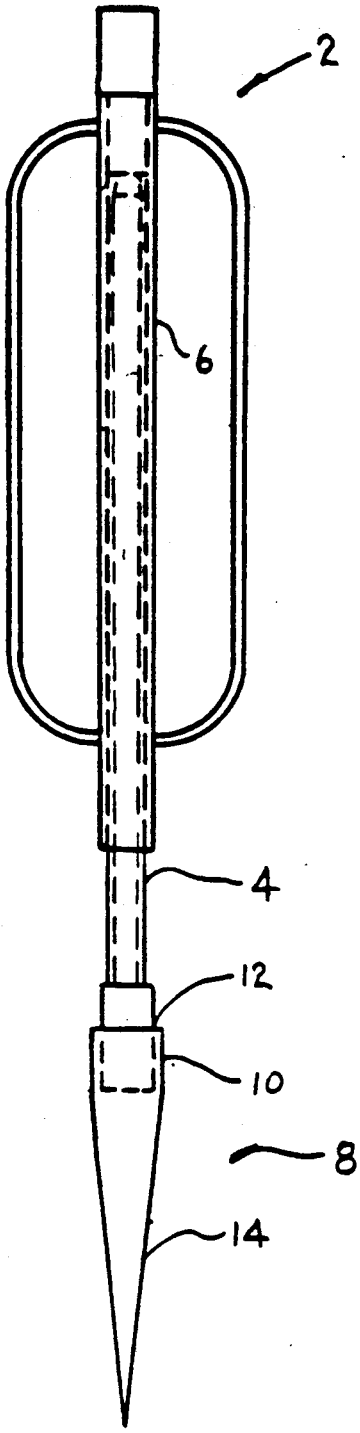
FIG. 1 is a side elevational view of the post driver.
Figure 7:
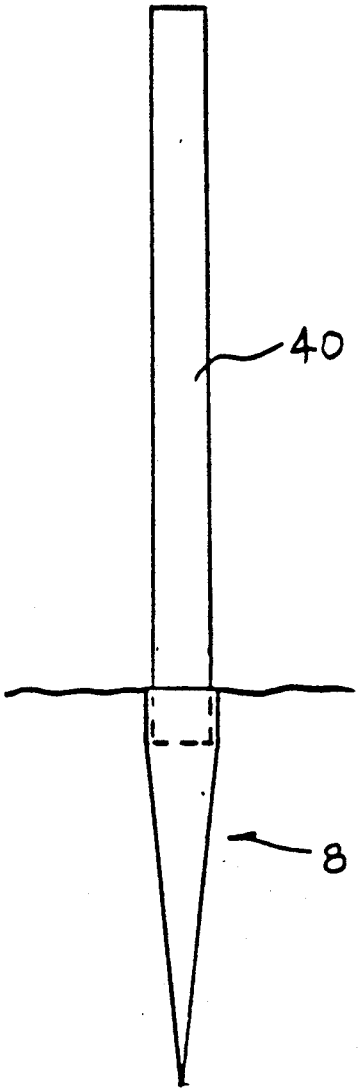
FIG. 7 illustrates a wooden post secured to a wedged anchor.

FIG. 1 generally illustrates the post driver 2 which comprises inner shaft 4 and outer shaft 6. The inner and outer shafts 4 and 6 respectively of post driver 2 act upon wedged anchor 8 which is adapted to be driven into the ground.

The wedged anchor 8 includes a post receiving portion or socket 10 having an opening 12 at the top thereof and a wedged spike 14 which is adapted to be driven into the ground by the post driver 2 in a manner which will be more fully described herein. The opening 12 has a square cross section for receiving a wooden post 40 having a square cross section.

Figure 2:
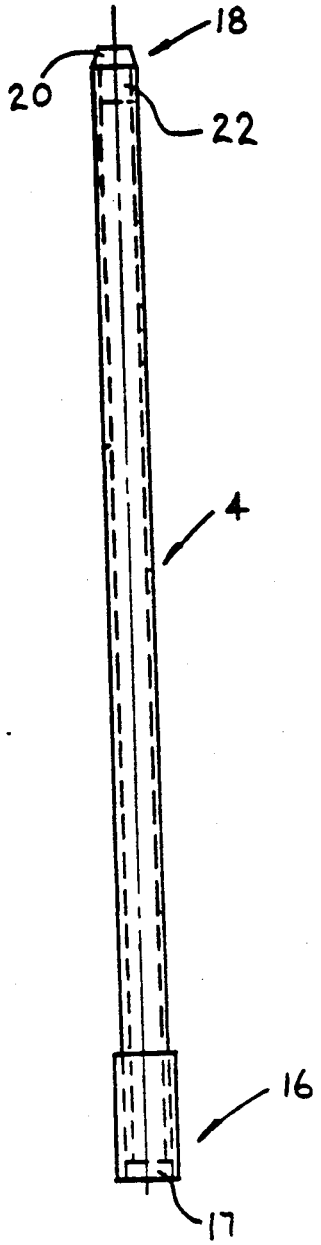
FIG. 2 is a side elevational view of the inner shaft of the post driver.
Figure 3:
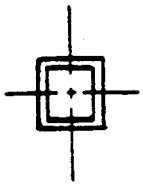
FIG. 3 is a bottom view of the inner shaft of the post driver.

FIG. 2 and 3 illustrate the inner shaft in more detail.

The inner shaft 4 comprises an elongated shaft extending along the axial length thereof and in the embodiment illustrated in FIGS. 2 and 3 comprises square tubbing having common wall thickness. It has been found that good results may be achieved by using two inch square tubbing having 3/16th inch walls. However, it should be understood that various sizes may be used without departing from the spirit of the invention herein.

One end 16 of inner shaft 4 is adapted to be inserted into the opening 12 of wedged anchor 8. In the embodiment disclosed in FIGS. 2 and 3 end 16 includes an enlarged engaging portion which consists of a three inch square tube with 7/16th inch walls which have been welded to four sides of the inner shaft 4. Again, various other dimensioned may be used without departing from the spirit of the invention. The enlarged engaging portion 16 has been dimensionable so as to snugly fit within opening 12 of wedged anchor 8. The wedged opening 12 also consists of a rectangular socket portion which is adapted to receive enlarged engaging portion 16 so as to substantially eliminate any rotational movement of wedged anchor 8 relative inner shaft 4 along its axial length thereof. This ensures proper vertical alinement of the wedged anchor as it is been driven into the ground by the post driver 2 in a manner which will be more fully described herein.

A square plate 17 is welded at the bottom of end 16.

Another end 18 of the inner shaft presents an anvil portion 20 which consists of a solid metal cap which is angled 15 degrees to the top and includes a protrusion 22 which is inserted into the end of the inner shaft 4. The anvil portion 20 is welded along four sides of the inner shaft 4 so as to properly secure same. However, other means of fastening may be utilized such as utilizing screws or dimensioning the anvil 20 to other end 18 so as to produce a press fit therebetween.

Figure 4:
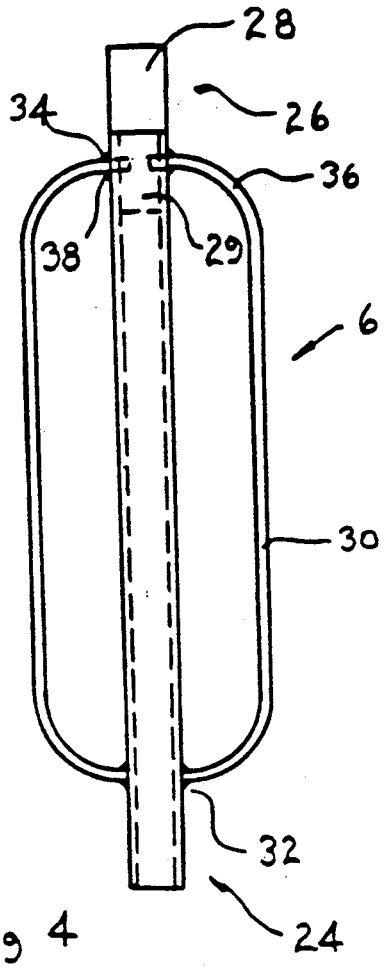
FIG. 4 is a side elevational view of the outer shaft of the post driver.
Figure 5:
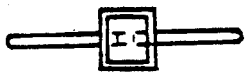
FIG. 5 is a bottom plan view of the outer shaft of the post driver.

The outer shaft 6 is hollow and presents a square cross section. Good results have been achieved by utilizing two and a half inch square tubbing having 3/16th inch common wall. Again, other dimensions may be used without departing from the spirit of the invention described herein. One end 24 of outer shaft 6 is hollow and is adapted to receive therein the other end 18 of inner shaft 4 for telescoping slidable relative movement therebetween. The other end 26 of outer shaft 6 is closed and in particular presents a solid mass of steel 28 which includes a portion 29 which is adapted to be inserted interiorally of outer shaft 6. In the embodiment shown in FIGS. 4 and 5 the solid mass of steel 28 comprises two and a half inch square solid mild steel cap which is milled to 2 and 1/16th inch square for protrusion into the other end 26 of outer shaft 6. The mass 28 may be welded to outer shaft 6.

Outer shaft 6 also includes handles 30 which are welded at lower end 32.

The upper end of outer shaft 6 includes drilled holes 34 which are also drilled into the portion 29 of mass 28 and are adapted to receive the other end 36 of handles 30. The other end 36 of handles 30 are welded at 38 to the outer shaft as shown.

The operation of the post driver 2 shall now be described in relation to FIG. 1. The wedged anchor is positioned so that the spike portion 14 is facing the ground and the open end 12 is at the top thereof.

Thereafter, inner shaft 4 is vertically aligned relative the wedged anchor by inserting the enlarged portion 16 into the open end 12. Thereafter, the outer shaft 6 is telescopingly mounted over the inner shaft 4 along a common axis. Alternatively, the inner shaft 4 may be placed in anteriority of outer shaft 6 and then the post driver 2 may be aligned with the wedged anchor as described above.

Thereafter, the user would grasp handles 30 of outer shaft 6 and raise the outer shaft 6 relative inner shaft 4 to an open position whereby the closed end 26 of outer shaft 6 is spaced from anvil 20 of inner shaft 4. Thereafter, the user would pull down on handles 30 so as to telescopingly slidingly move outer shaft 6 relative inner shaft 4 to a second impact position whereby the mass 28 would strike anvil portion 20 of inner shaft 4 so as to transfer the force along inner shaft 4 into the open end 12 of wedged anchor 8 so as to drive the wedged anchor 8 into the ground.

It should be noted that it has been found that the wedged anchor 8 is more accurately vertically aligned into the ground by utilizing the post driver 2 as described above. More particularly, handles 30 of post driver 3 allow the operator to drive the wedged anchor or fence post holder down perpendicularly to the horizontal while at the same time driving the fence post holder 8 parallel to a fence line. The handles 30 act as a wrench whereby adjustments can be made while driving the wedged anchor into the ground.

Furthermore, it has been found that by utilizing a hollow inner and outer shaft 4 and 6 respectively while having anvil portion 20 and mass portion 28 a light weight yet affective force transfer mechanism has been accomplished which eases the accurate insertion of wedged anchors 8 into the ground.

Figure 6:
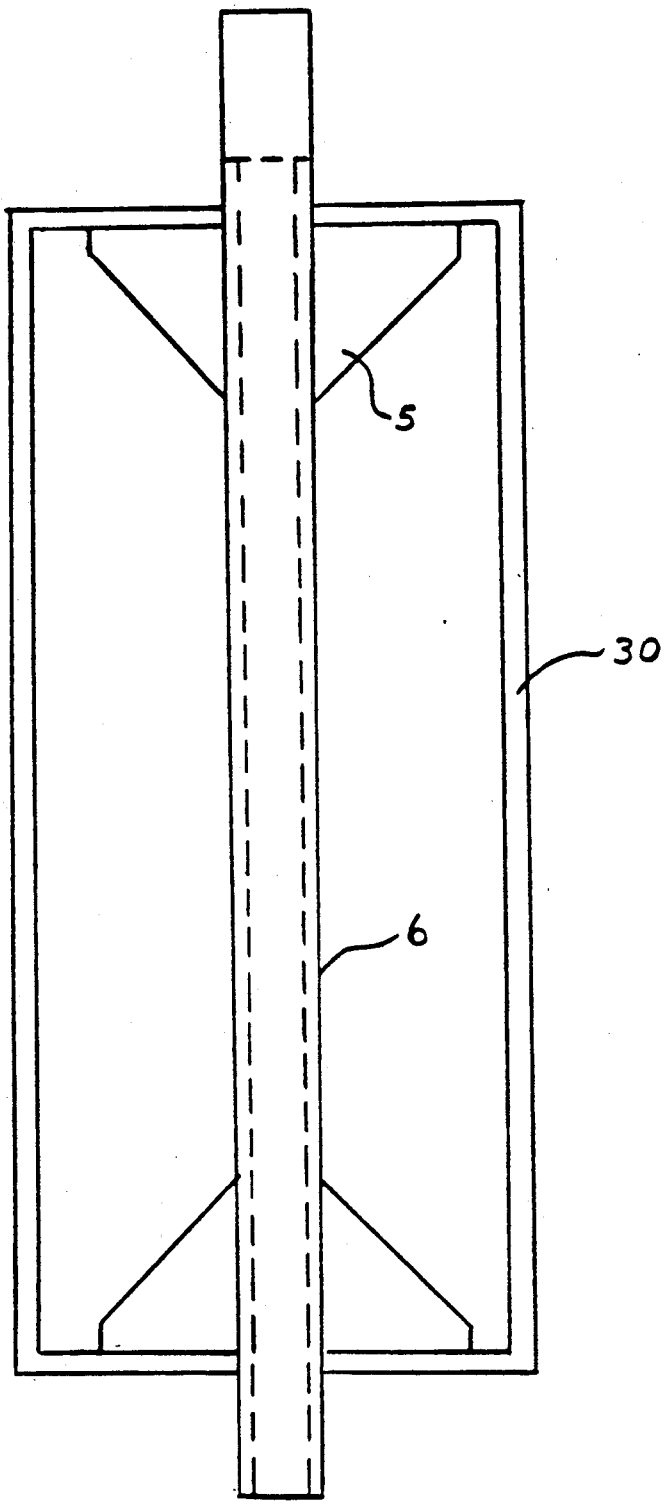
FIG. 6 is a side elevational view of a second embodiment of the outer shaft having gussets.

FIG. 6 discloses a second embodiment of the invention which includes gussets 40 that connect outer shaft 6 to handles 30 so as to reinforce and strengthen same.

Finally, once the wedged anchor 8 has been driven sufficiently into the ground the inner and outer shafts 4 and 6 may be removed from the wedged anchor 8 and a wooden post 40 inserted into the open end of wedged anchor 8.

Although the preferred embodiment as well as the operation and use have been specifically described in relation to the drawings, it should be understood that variations in the preferred embodiment could be achieved by a person skilled in the trade without departing from the spirit of the invention. Accordingly, the invention should not be understood as to be limited to the exact form revealed by the drawings.

The embodiments of the invention in which an exclusive property or privileges is claimed are defined as follows:

1. A post driver for driving an wedged anchor into the ground, wherein said wedged anchor is adapted to receive a post at the top end thereof, comprising:

(a) an elongated inner shaft having a rectangular cross section said inner shaft having one end of which is adapted to be received by said wedged anchor;

(b) a plate coextensive with said rectangular cross section and fixedly secured at said one end of said elongated inner shaft;

(c) a hollow elongated outer shaft having spaced first and second open ends said first open end of said hollow elongated outer shaft adapted to receive another end of said inner shaft for relative slidable movement therebetween;

(d) mass means presented at said second open end extending interiorially into said outer shaft, said mass means adapted to strike said other end of said inner shaft when said outer shaft is slidingly moved to an impact position and to be spaced from said other end of said inner shaft when said outer shaft is slidingly moved relative said inner shaft to an open position;

(e) said hollow outer shaft including first aperture means and said mass means including second aperture means in the region interiorially of said outer shaft for alignment with said first aperture means;

(f) a pair of handle means each having two spaced ends secured to said outer shaft, one of said ends of said handle means projecting through said first aperture means of said outer shaft and into said second aperture means of said mass means interiorially of said outer shaft so as to retain said mass means and said outer shaft means together, said handle means for moving said outer shaft relative said inner shaft between said open and impact positions.

2. A post driver as claimed in claim 1 wherein said outer shaft has an inner rectangular cross section for slidably receiving said inner shaft between said impact and open positions.

3. In a post as claimed in claim 2 wherein each said handle means includes two spaced gussets disposed at the ends of said handles and said outer shaft.

4. A post driver as claimed in claim 3 wherein said inner shaft includes an enlarged portion at said one end for engagement with said wedged anchor.

5. A post driver as claimed in claim 4 wherein said inner shaft includes an anvil portion at said other end for contact with said mass means at said outer shaft in said second impact position.

6. A post driver for driving a wedged anchor into the ground, said wedged anchor including a square opening at the top thereof for receiving a wooden post comprising;

(a) a hollow inner shaft having a square cross section along the axial length thereof;

(b) a plate coextensive with said square cross section of said inner shaft and fixedly secured at said one end of said hollow inner shaft;

(c) an enlarged square engaging portion presented at one end of said inner shaft for reception by said opening at the top of said wedged anchor so as to substantially eliminate rotational movement of said wedged anchor about said axis of said hollow inner shaft;

(d) anvil means presented at another end of said inner shaft;

(e) a hollow outer shaft having a square cross section along the axial length thereof, said outer shaft including an open end adapted to slidingly receive said inner shaft interiorially of said outer shaft for relative slidable movement therebetween so as to substantially eliminate rotational movement of said outer shaft with said inner shaft along the axial length of inner and outer shafts;

(f) mass means presented at another end of said outer shaft and extending interiorially into said outer shaft at said another end, said mass means adapted to strike said anvil means of said inner shaft when said outer shaft is slidingly moved to an impact position, and to be spaced from said anvil means when said outer shaft is slidingly moved relative said inner shaft to an open position;

(g) said hollow outer shaft including first aperture means and said mass means including second aperture means in the region interiorially of said outer shaft for alignment with said first aperture means;

(h) a pair of handle means each having two spaced ends secured to said outer shaft, one of said ends of said handle means projecting through said first aperture means of said outer shaft and into said second aperture means of said mass means interiorially of said outer shaft so as to retain said mass means and said outer shaft means together, said handle means for moving said outer shaft relative said inner shaft between said open and impact positions; and (i) gusset means connecting said outer shaft and said handle means.

7. A post driver as claimed in claim 1 wherein said plate is welded at said one end perpendicular to said elongated inner shaft.

8. A post driver as claimed in claim 6 wherein said one end of each said handle means is welded to said outer shaft.

9. A post driver as claimed in claim 8 wherein said other end of each said handle means is welded to said outer shaft.

* * * * *